US010794121B2

(12) United States Patent
Hanton et al.

(10) Patent No.: US 10,794,121 B2
(45) Date of Patent: Oct. 6, 2020

(54) CONNECTING ASSEMBLY AND RECEPTACLE ADAPTED TO RECEIVE SAID CONNECTING ASSEMBLY FOR CONNECTING TWO TUBING SECTIONS, AND METHOD FOR INSTALLING AND CONNECTING TWO TUBING SECTIONS IN A WELLBORE

(71) Applicants: TERCEL IP LIMITED, Road Town, Tortola (VG); TERCEL OILFIELD PRODUCTS BELGIUM SA, Gosselies (BE)

(72) Inventors: John Hanton, Dyce (GB); Jeffrey B. Lasater, Houston, TX (US); Thomas Marr Graeme, Inverurie (GB); Jayson Alexander Byrd, Humble, TX (US)

(73) Assignee: TERCEL IP LIMITED, Tortola (VG)

( * ) Notice: Subject to any disclaimer, the term of this patent is extended or adjusted under 35 U.S.C. 154(b) by 38 days.

(21) Appl. No.: 15/551,179

(22) PCT Filed: Feb. 4, 2016

(86) PCT No.: PCT/EP2016/052351
§ 371 (c)(1),
(2) Date: Aug. 15, 2017

(87) PCT Pub. No.: WO2016/131662
PCT Pub. Date: Aug. 25, 2016

(65) Prior Publication Data

US 2018/0030789 A1 Feb. 1, 2018

(30) Foreign Application Priority Data

Feb. 16, 2015 (EP) ..... 15155270

(51) Int. Cl.
*E21B 17/046* (2006.01)
*E21B 17/04* (2006.01)
(Continued)

(52) U.S. Cl.
CPC ..... *E21B 17/046* (2013.01); *E21B 17/04* (2013.01); *E21B 17/043* (2013.01); *E21B 17/06* (2013.01)

(58) Field of Classification Search
CPC ..... E21B 17/046; E21B 17/04; E21B 23/00; E21B 17/00; E21B 43/10
See application file for complete search history.

(56) References Cited

U.S. PATENT DOCUMENTS 5,439,051 A * 8/1995 Kennedy ..... E21B 23/03 166/117.6
6,213,206 B1 4/2001 Bakke
(Continued)

*Primary Examiner* — Robert E Fuller
*Assistant Examiner* — Theodore N Yao
(74) *Attorney, Agent, or Firm* — Pillsbury Winthrop Shaw Pittman LLP

(57) ABSTRACT

The invention relates to a connecting assembly to be plugged into a mating receptacle in a wellbore, comprising a first sleeve including a second sleeve and having a top connecting end and a bottom connecting end, characterized in that: —the first sleeve comprises the bottom end and has a top end opposite to said bottom connecting end, said bottom connecting end being provided with an end cap for preventing entrance of materials and capable of being opened; —said second sleeve comprises said top connecting end located outside of the first sleeve and has a bottom end opposed to said top connecting end; —said connecting assembly comprises a locking mechanism adapted to lock said second sleeve in a position relative to said first sleeve such that the bottom end of the second sleeve is inside said first sleeve, and —the dimensions of the first sleeve and second sleeve are adapted such that when said locking
(Continued)

mechanism is unlocked, said second sleeve is allowed to move relative to said first sleeve to impinge and open said end cap.

20 Claims, 11 Drawing Sheets

(51) Int. Cl.
*E21B 17/06* (2006.01)
*E21B 17/043* (2006.01)

(56) References Cited

U.S. PATENT DOCUMENTS

| | | | | |
|---|---|---|---|---|
| 6,334,488 | B1 * | 1/2002 | Freiheit | E21B 34/063 166/142 |
| 6,450,541 | B1 | 9/2002 | Bakke | |
| 7,314,100 | B2 | 1/2008 | Roggeband | |
| 8,376,066 | B2 * | 2/2013 | Steele | E21B 41/0035 166/117.5 |
| 2004/0040709 | A1 | 3/2004 | Rogers et al. | |
| 2006/0260818 | A1 * | 11/2006 | Meijer | E21B 17/023 166/380 |
| 2011/0168406 | A1 * | 7/2011 | Du | E21B 17/023 166/380 |
| 2012/0042966 | A1 * | 2/2012 | Ross | E21B 34/103 137/517 |
| 2014/0352975 | A1 | 12/2014 | Rogers et al. | |
| 2015/0315881 | A1 * | 11/2015 | Bowen | E21B 43/086 166/205 |
| 2016/0230478 | A1 * | 8/2016 | Dietz | E21B 43/10 |

* cited by examiner

CONNECTING ASSEMBLY AND RECEPTACLE ADAPTED TO RECEIVE SAID CONNECTING ASSEMBLY FOR CONNECTING TWO TUBING SECTIONS, AND METHOD FOR INSTALLING AND CONNECTING TWO TUBING SECTIONS IN A WELLBORE

TECHNICAL FIELD

In a first aspect, the present invention relates to a connection assembly for connecting a first tubing section to a second tubing section. In a second aspect, the present invention relates to a receptacle adapted to receive the connection assembly for connecting the first tubing section to the second tubing section. In a third aspect, the present invention relates to a method for installing and connecting two tubing sections in a wellbore wherein a first tubing section is provided with a receptacle and the second tubing section is provided with a connection assembly.

STATE OF THE ART

Realization of an oil or gas well involves steps of drilling a wellbore and steps of completion of the drilled wellbore. Typically, a wellbore is drilled in a few steps. A first portion of the wellbore is drilled using a large diameter drilling tool. When the drilling of the first portion of the wellbore is accomplished, a casing string is lowered down into the drilled portion of the wellbore. A casing string is a tubular assembly of casings pipes assembled at the surface of the well. Advantageously, a casing shoe is screwed to the bottom of the casing string and provides a rounded profile to the bottom of the casing string, which helps to guide the casing string into the drilled portion and to get through any ledge or obstructions in the drilled portion. The casing string may be also provided with centralizers for centralizing the casing string into the borehole. The casing shoe is generally drillable for allowing the drilling of a subsequent portion of the wellbore. When the casing string reaches the bottom of the drilled portion, a further step of cementing the casing string against the wall of the borehole is performed. The main functionalities of a cemented casing in a wellbore are:

- stabilization of the wellbore, particularly if the wellbore crosses some unstable formations, in which case the casing prevents the formation wall from caving into the wellbore;
- isolating incompatible formations or zones, for example isolating ground water from contamination of another formation or isolating zones having different pressures;
- providing strong foundations allowing the use of high-density and/or highly pressurized drilling fluids;
- providing a smooth borehole facilitating the insertion of a downhole tool, such as a drill bit, a screen or a liner, and reducing the risk of the downhole tool becoming stuck.

Once a first portion of the wellbore has been drilled and stabilized by cemented casings, the same steps of drilling and casing cementation are performed using decreasing diameter drill bits and decreasing diameter casing strings.

The last casing string portion is called the production casing. The production casing generally does not extend from the surface of the wellbore to the bottom of the wellbore, but extends from the bottom of an upper cased portion of the wellbore to the bottom of the wellbore. Such a casing string is also called a liner. The liner is attached to a work string and lowered in the deepest borehole portion of the well. Then, the liner is attached to the walls of an upper cemented casing portion of the wellbore by a liner hanger. The liner is cemented and a cased hole sealed off from natural fluids is obtained. The production casing passes through the zone containing the oil or gas. Once the wellbore is cemented by casing, a perforation tool is lowered into the zone of interest and holes are blasted through the walls of the casing, through the cement sheath and through about one meter into the formation rock. The casing is generally not used as a conduit for bringing oil and gas to the surface. This operation is performed by inserting through the casing a production tubing that comprises a packer at the bottom. The packer is expanded in the annulus comprised between the production tubing and the casing, some way up from the perforated zone, for sealing off the tubing from the casing. Operation in a wellbore includes the steps of insertion and cementation of the casing string and also some further steps of perforation, stimulation, gravel packing and tubing, involving the insertion of specific tools. For example, when the wellbore crosses some weak subterranean formations such as sandstone, tools like sand control screens are attached to a work string and lowered into the wellbore for maintaining the structure of the reservoir around the wellbore. Mixing of sand and fluid leads to the creation of an abrasive fluid. A sand control screen acts like a filter that allows ingress of reservoir fluid to the production string while preventing migration of sand into the wellbore and erosion of equipment that would be exposed to abrasive fluid. Sand control screens are quite delicate and easily susceptible to damage during deployment of the string into the wellbore. When lowering strings like casing strings, liners, completion strings or production strings, into a deep and highly deviated wellbore, there is often insufficient string down weight available to the operator to place the string into the well without rotating the string to break the friction. Applying too much downhole weight can over-compress the pipe below, thereby causing damage. It is advantageous to rotate the work string when inserting in high angle/ERD (extended reach drilling) or tortuous wells due to the fact that the associated drag of the friction is reduced in the string, making it easier to observe and apply the necessary measured down weight to aid getting the bottom of the work string to the planned depth. However, it is often not desirable to rotate the bottom section of the string (that may comprise delicate accessories) for fear of damage. For example, if a completion tool, or bottom casing or liner sticks, buckling can occur as a result of the applied torque.

As extended reach wells become deeper and production zones become longer, it becomes impossible to push liner/screen assemblies which cannot be rotated. Therefore, an option is to deploy the liner/screen assemblies in shorter, multiple sections, in multiple stages. In order to facilitate this, there is a need for a system whereby an upper liner/screen section can mate with a previously deployed lower liner/screen section.

SUMMARY OF THE INVENTION

According to a first aspect, the present invention relates to a connecting assembly to be plugged into a mating receptacle, the connecting assembly comprising a first sleeve including a second sleeve, the connecting assembly having a top connecting end, and a bottom connecting end, characterized in that:

- the first sleeve comprises the bottom end and a has a top end opposite to the bottom connecting end, the bottom connecting end being provided with an end cap for preventing entrance of materials and capable of being opened;

the second sleeve comprises the top connecting end located outside of the first sleeve and has a bottom end opposed to the top connecting end;

the connecting assembly comprises a locking mechanism adapted to lock the second sleeve in a position relative to the first sleeve such that the bottom end of the second sleeve is inside the first sleeve, and the dimensions of the first sleeve and second sleeve are adapted such that when the locking mechanism is unlocked, the second sleeve is allowed to move relative to the first sleeve to impinge and open the end cap.

Preferably, the end cap comprises scores, perforations, slots or other predefined breaking points for facilitating its opening.

Preferably, the end cap has a convex shape protruding from the bottom connecting end.

Preferably, the first sleeve of the connecting assembly comprises an external shoulder adapted to be retained by a mating receptacle.

Preferably, the second sleeve comprises an external shoulder and the first sleeve comprises an abutment adapted to retain the external shoulder of the second sleeve.

Preferably, the connecting assembly comprises a latching mechanism adapted to lock the connecting assembly to a mating receptacle.

Preferably, the connecting assembly further comprises:

a third sleeve surrounding at least a portion of the first sleeve, and a locking mechanism, between the third sleeve and the first sleeve adapted to:

lock the third sleeve in a first position relative to the first sleeve wherein the third sleeve covers the latching mechanism and;

unlock the third sleeve from the first sleeve to allow movement of the first sleeve relative to the third sleeve such as to uncover the latching mechanism or seals or preferably the latching mechanism and seals when the connection assembly is plugged into the receptacle.

Preferably, the locking mechanism for locking the second sleeve relative to the first sleeve comprises:

a bore sensing ball bearing mechanism comprising balls secured in the wall of the first sleeve, the balls being secured between retaining nut and a split ring that is:

in a locking position while the connecting assembly is outside of the receptacle, the locking position wherein the balls protrudes from the external surface of the first sleeve and wherein the split ring is positioned halfway between an internal groove made in the first sleeve and an external groove made in the second sleeve, loading the ring in shear such that movement of the second sleeve relative to the first sleeve is prevented, and;

in an unlocking position after entrance of the connecting assembly into the receptacle, the unlocking position wherein the split ring is entirely inside the external groove of the second sleeve once all the balls have been pushed against the split ring, such that the movement of the second sleeve relative to the first sleeve is allowed, or;

a shear pin provided between the first sleeve and the second sleeve, or preferably a combination of both.

Preferably, the locking mechanism for locking the third sleeve to the first sleeve comprises:

a bore sensing ball bearings mechanism, comprising balls secured in the wall of the third sleeve, and being secured between retaining nut and a split ring that is:

in a locking position while the connecting assembly is outside of the receptacle, wherein the balls protrudes from the external surface of the third sleeve and wherein the split ring is positioned halfway between an internal groove made in the third sleeve and an external groove made in the first sleeve such that movement of the third sleeve relative to the first sleeve is prevented, and;

in an unlocking position while the bore sensing ball bearing mechanism is entering into the receptacle and while the bore sensing ball bearing mechanism is into the receptacle, the unlocking position wherein the split ring is entirely inside the external groove of the first sleeve once all the balls have been pushed against the split ring, such that the movement of the third sleeve relative to the first sleeve is allowed, or;

a shear pin provided between the third sleeve and the first sleeve, or a combination thereof.

Preferably, the second sleeve comprises an outwardly extending buttress thread and the first sleeve comprises an inwardly extending ratchet ring, the buttress thread and the ratchet ring being arranged to prevent backwards movement of the second sleeve.

Preferably, a first sealing means is arranged between the first sleeve and the second sleeve, and a second sealing means is arranged around the first sleeve.

According to a second aspect, the present invention relates to a receptacle comprising a bore, a top connecting end adapted to receive a connecting assembly such as described in the present specification, and a bottom connecting end for connection to a first tubing section.

According to a third aspect, the present invention relates to a method for installing and connecting a first tubing section and a second tubing section in a wellbore, comprising the steps of:

(i) lowering a first tubing section into a wellbore;

(ii) providing a receptacle to the first tubing section;

(iii) providing a connecting assembly as disclosed in the present specification to a second tubing section and lowering the second tubing section with the connection assembly oriented towards the receptacle to plug the connection assembly into the receptacle.

Preferably, the first tubing section provided with the receptacle is attached to a work string comprising a swivel assembly and the part of the work string located upstream the swivel assembly is rotated relative to the part of the work string located downstream the swivel assembly that comprises the first tubing section provided with the receptacle.

DETAILED DESCRIPTION OF THE PRESENT INVENTION

Figure 1A:
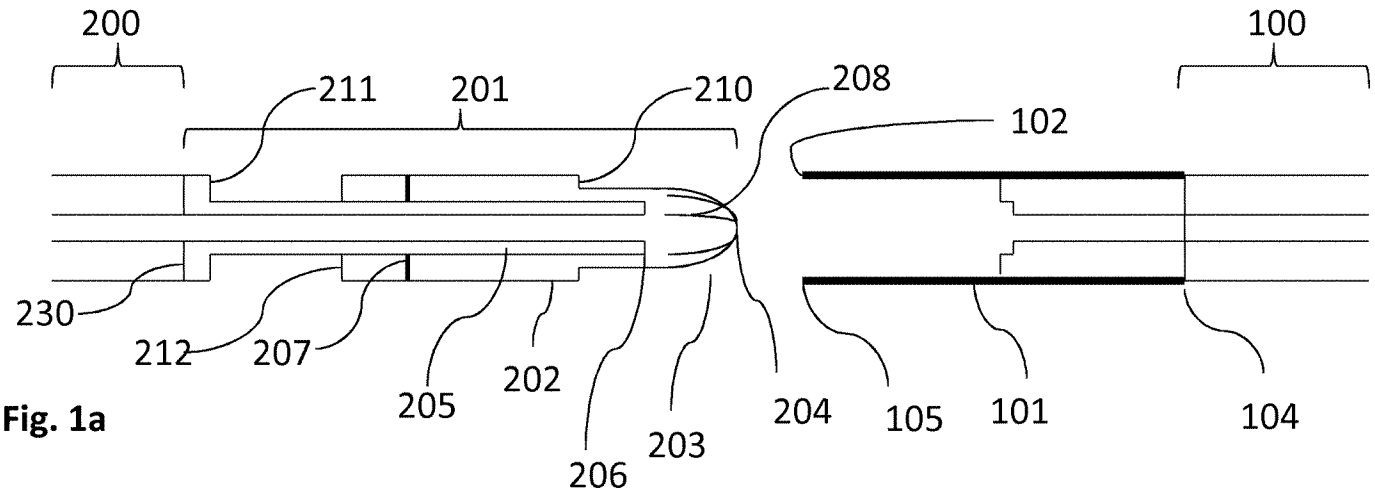
FIG. 1*a* shows simplified schematic views of a first tubing section and of a second tubing section disconnected from each other, wherein the first tubing section comprises a receptacle and the second tubing section comprises a connecting assembly, the receptacle and the connecting assembly being represented according to an embodiment of the present invention.

In a first aspect, the present invention relates to a connecting assembly 201 to be plugged into a mating receptacle 101, the connecting assembly comprising a first sleeve 202 including a second sleeve 205, the connecting assembly having a top connecting end 230, and a bottom connecting end 203, characterized in that:

- the first sleeve 202 comprises the bottom end 203 and has a top end 212 opposite to the bottom connecting end 203, the bottom connecting end 203 being provided with an end cap 204 for preventing entrance of materials and capable of being opened;
- the second sleeve 205 comprises the top connecting end 230 and has a bottom end 206 opposed to the top connecting end 230;
- the connecting assembly comprises a locking mechanism 207 adapted to lock the second sleeve 205 in a position relative to the first sleeve 202 such that the bottom end 206 of the second sleeve 205 is inside the first sleeve 202, and
- the dimensions of the first sleeve 202 and second sleeve 205 are adapted such that when the locking mechanism 207 is unlocked, the second sleeve 205 is allowed to move relative to the first sleeve 202 to impinge and open the end cap 204.

The connecting assembly 201 is a part of a connection interface that further comprises a mating receptacle 101 for connecting a first tubing section 100 provided with the receptacle 101, to a second tubing section 200 provided with the connecting assembly 201.

Preferably, the first tubing section is a section of a casing string or a liner or a section of a liner or a screen. The second tubing section may also be a section of a casing string or a liner or a section of a liner or a screen.

Figure 1B:
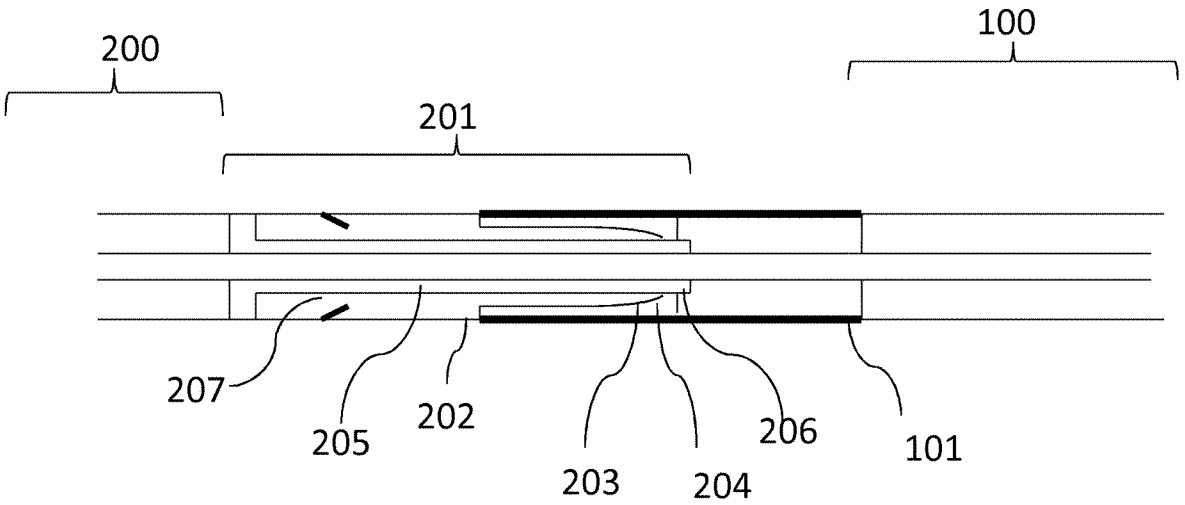
FIG. 1*b* shows a simplified schematic view of the first tubing section and the second tubing section of FIG. 1*a* wherein the connecting assembly is connected to the receptacle.

The connecting assembly 200 of the present invention is represented according to a first embodiment in FIGS. 1*a* and 1*b*. FIG. 1*a* shows a first tubing section 100 provided with a receptacle 101 and a second tubing section 200 provided with a connecting assembly 201, before plugging the connecting assembly 201 into the receptacle 101. FIG. 1*b* shows the first tubing section 100 and the second tubing section 200 with the connecting assembly 201 plugged into the receptacle 101 and the end cap 204 of the first sleeve 202 opened by the bottom end 206 of the second sleeve 205, providing a fluidic connection between the first tubing section 100 and the second tubing section 200.

In a first embodiment of the present invention, the locking mechanism 207 can be a shear pin or a set of shear pins arranged between an inner surface of the first sleeve 202 and an external surface of the second sleeve 205. The locking mechanism 207 may comprise alternatively or in addition with the shear pin a set of bore sensing ball bearings 207*a* provided in the walls of the first sleeve 202, and comprising balls 216*a* secured into a retaining nut 216*b*, the balls 216*a* protruding from the external surface of the first sleeve 202 and being connected to a split ring 217 that is:

- in a locking position while the connecting assembly is outside of the receptacle, the locking position wherein the split ring is positioned halfway between an internal groove 218 made in the first sleeve 202 and an external groove 219 made in the second sleeve 205 such that movement of the second sleeve 205 relative to the first sleeve 202 is prevented, and;
- in an unlocking position after entrance of the connecting assembly into the receptacle, wherein the split ring is entirely inside the external groove of the second sleeve once all the balls have been pushed against the split ring, such that the movement of the second sleeve 205 relative to the first sleeve 202 is allowed, and such that the second sleeve 205 can impinge and open the end cap 204 upon a pushing force applied on the second sleeve 205.

Preferably, a shoulder is provided on the external surface of the first sleeve 202 between its top end 212 and the balls 216*a*, to prevent contact of the balls with the walls of the wellbore and then to prevent undesired unlocking of the first sleeve from the second sleeve.

Alternatively, the first locking mechanism 207 may be a locking device electronically actuated, for example by Radio frequency identification (RFID) means wherein a RFID tag is provided on a receptacle 101 and a RFID reader is provided on the connecting assembly 201 or inversely, such that when the connecting assembly is plugged in the receptacle, a signal is sent to the locking device that allows unlocking of the locking mechanism.

Preferably, the end cap 204 comprises scores 208 for facilitating its opening when the second sleeve 205 is unlocked from the first sleeve 202 and is pushed against the end cap 204.

Preferably, the end cap 204 has a convex shape protruding from the first bottom end 203 of the first sleeve 202. The shape of the end cap is advantageously profiled as a shoe for easier penetration into the wellbore. The connecting assembly of the connection interface according to the present invention is advantageous over the prior art devices in that the end cap prevents drilling debris or collapsed formations to enter in the second tubing while running in hole and maintains a barrier to debris in case of a failure to seat in the receptacle. Another advantage is that the fluidic connection between the first tubing and the second tubing is established when the connecting assembly is plugged into the receptacle and the second sleeve is pushed towards the first sleeve extremity to open the end cap 204. There is no shoe to be drilled when the second tubing section is connected to the first tubing section, which saves time and costs for the realization of the wellbore.

The first sleeve 202 of the connecting assembly 201 comprises a first external shoulder 210 at a first axial distance from the end cap 204, the external shoulder being adapted to be intercepted by an abutment 102 of a mating receptacle 101. The abutment 102 of the receptacle may be a section of the receptacle having a reduced inner diameter relative to the main inner diameter of the receptacle or may be the top end 105 of the receptacle 101.

Preferably, the second sleeve 205 comprises an external shoulder 211 and the first sleeve 202 comprises an abutment 212 adapted to retain the external shoulder 211 of the second sleeve 205. The abutment 212 may be a section of the first sleeve having a reduced inner diameter relative to the main inner diameter of the first sleeve. Preferably, the external shoulder 211 of the second sleeve is provided outside of the first sleeve 202 and the abutment 212 of the first sleeve 202 for the external shoulder 211 of the first sleeve is the top extremity 212 of the first sleeve 202.

Preferably, the connecting assembly 202 comprises a latching mechanism 209 adapted to lock the connecting assembly 201 to a receptacle 101. The latching mechanism 209 can be a buttress thread provided on the external surface of the first sleeve 202 and adapted to engage with a ratchet ring provided in an inner surface of a receptacle 101 when the connecting assembly enters into the receptacle. Alternatively, the latching mechanism 209 provided on the external surface of the first sleeve 202 can be a latching pin maintained in a compressed position between a spring and a cover, the cover that can be moved by an abutment provided on the receptacle upon entrance of the connecting assembly into the receptacle for allowing the pin to expand and to lock the first sleeve 202 to the receptacle 101. Alternatively, a latching ring surrounding the first sleeve 202 may be employed in place of the latching pin. In another embodiment, any of the latching mechanism cited above for locking the connecting assembly to a receptacle can be provided on the second sleeve 205, and the first sleeve 202 may act as a cover for maintaining the latching mechanism in its compressed position, provided that the dimensions of the second sleeve and the first sleeve and the location of the latching mechanism are arranged such that when the second sleeve has opened the end cap 204, the latching mechanism is positioned outside the first sleeve and in a position into the receptacle adapted to lock the connection assembly 201 to the receptacle 101. Alternatively, the latching mechanism 209 may be electronically actuated, for example by Radio frequency identification (RFID) means wherein a RFID tag is provided on a receptacle 101 and a RFID reader is provided on the connecting assembly 201 or inversely, such that when the connecting assembly is plugged in the receptacle, a signal is sent to a device that allows unlocking of the second latching mechanism. Any other suitable latching mechanism can be envisaged by the man skilled in the art.

Figure 2:
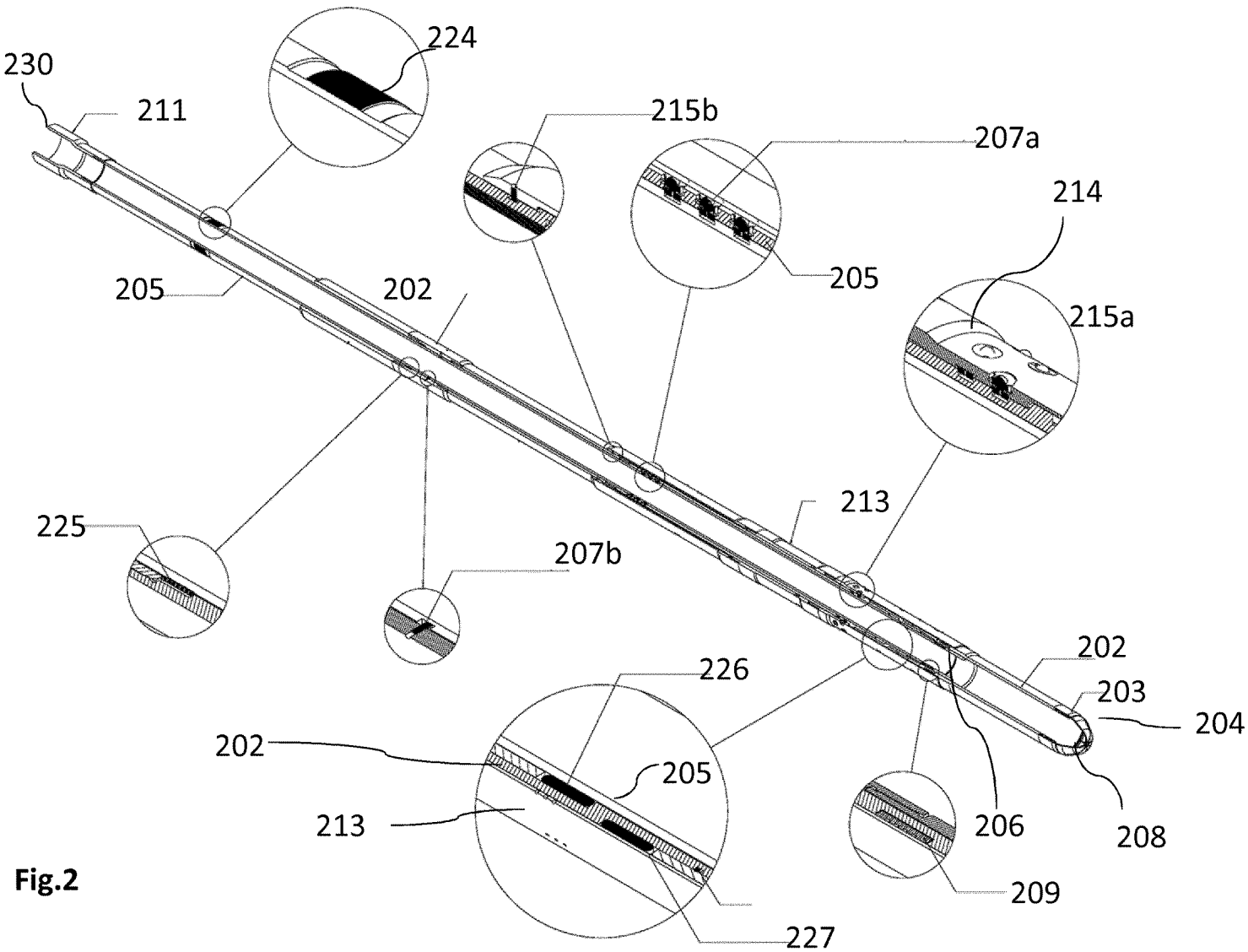
FIG. 2 shows a longitudinal cross section of a connecting assembly according to an embodiment of the present invention, and some enlarged views of some parts of the connection assembly.

The FIG. 2 represents a second embodiment of a connecting assembly 201 according to the present invention. The FIGS. 5 to 8 represent a sequence of steps in which the connecting assembly 201 according to the embodiment of FIG. 2 is plugged into a mating receptacle 101. The connecting assembly 201 comprises a top end 230 having a connecting means, preferably a threaded connection means, for connection to the second tubing section 200, and a bottom end 203 to be plugged into the top end 105 of the receptacle 101. The connecting assembly 201 comprises a first sleeve 202 including a second sleeve 205, the connecting assembly having a top connecting end 230, and a bottom connecting end 203, characterized in that:

- the first sleeve 202 comprises the bottom end 203 and has a top end 212 opposite to the bottom connecting end 203, the bottom connecting end 203 being provided with an end cap 204 for preventing entrance of materials and capable of being opened;
- the second sleeve 205 comprises the top connecting end 230 and has a bottom end 206 opposed to the top connecting end 230;
- the connecting assembly comprises a locking mechanism 207 adapted to lock the second sleeve 205 in a position relative to the first sleeve 202 such that the bottom end 206 of the second sleeve 205 is inside the first sleeve 202, and
- the dimensions of the first sleeve 202 and second sleeve 205 are adapted such that when the locking mechanism 207 is unlocked, the second sleeve 205 is allowed to move relative to the first sleeve 202 to impinge and open the end cap 204.

As presented in the embodiment of FIG. 1, the end cap 204 comprises scores 208 for facilitating its opening when the second sleeve 205 is unlocked from the first sleeve 202 and is pushed against the end cap 204. Also, the end cap 204 has a convex shape protruding from the first sleeve extremity 203.

Figure 3A:
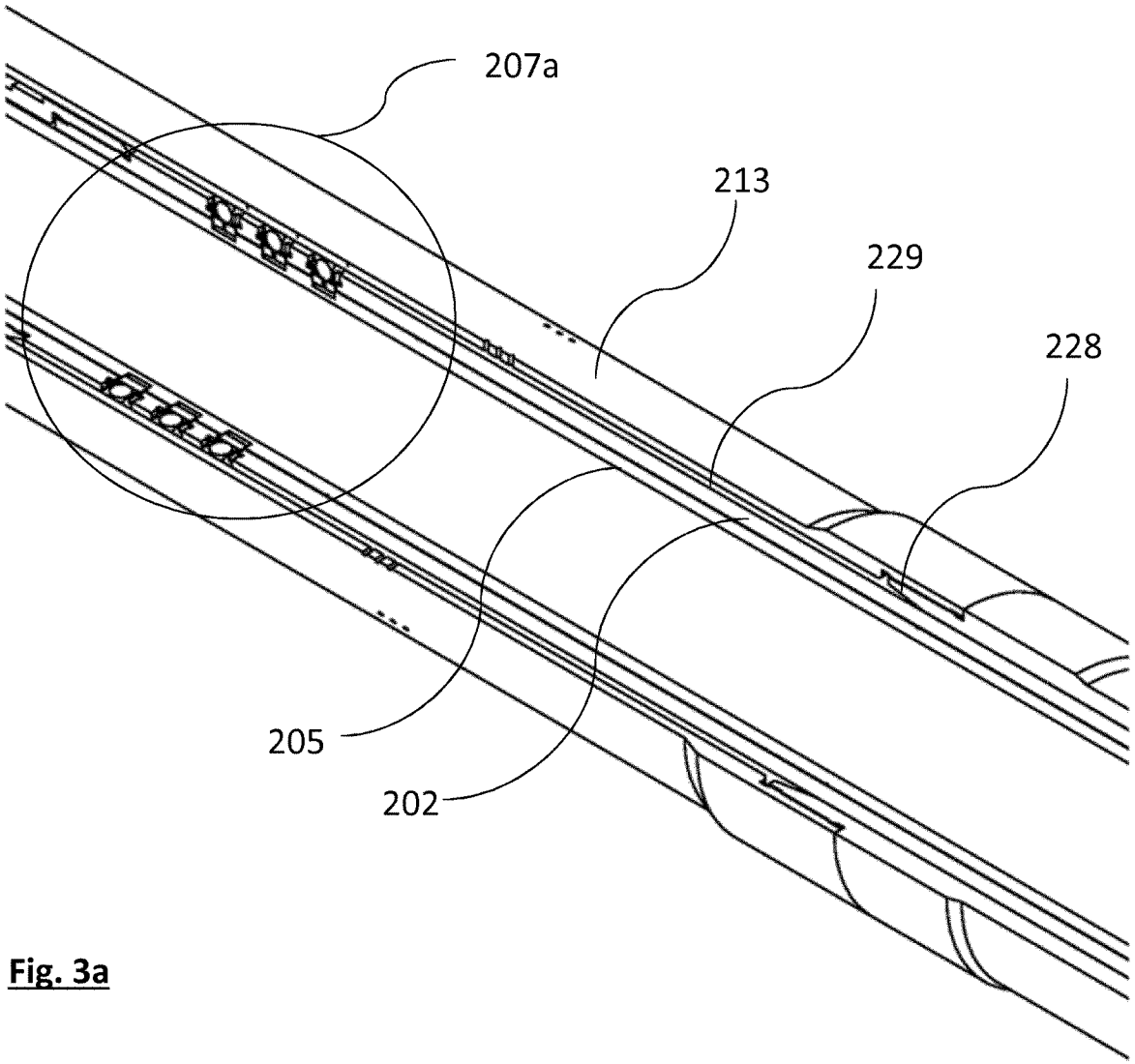
FIG. 3*a* shows an enlarged view of a part of the connecting assembly according to the embodiment of the present invention of FIG. 2.
Figure 3B:
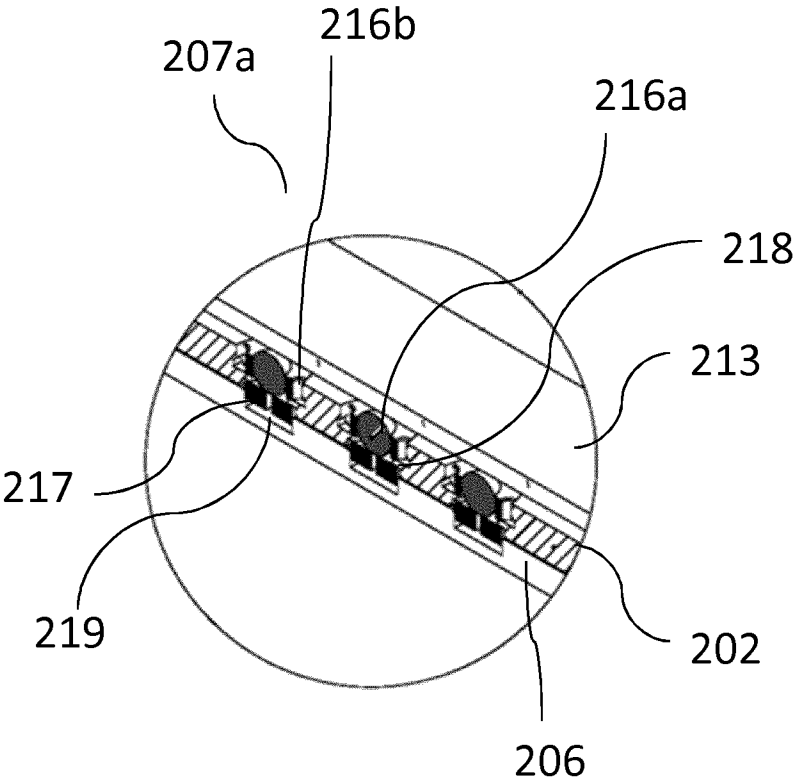
FIG. 3*b* shows a more enlarged view of a part of the part of the connecting assembly represented on FIG. 3*a*.
Figure 5:
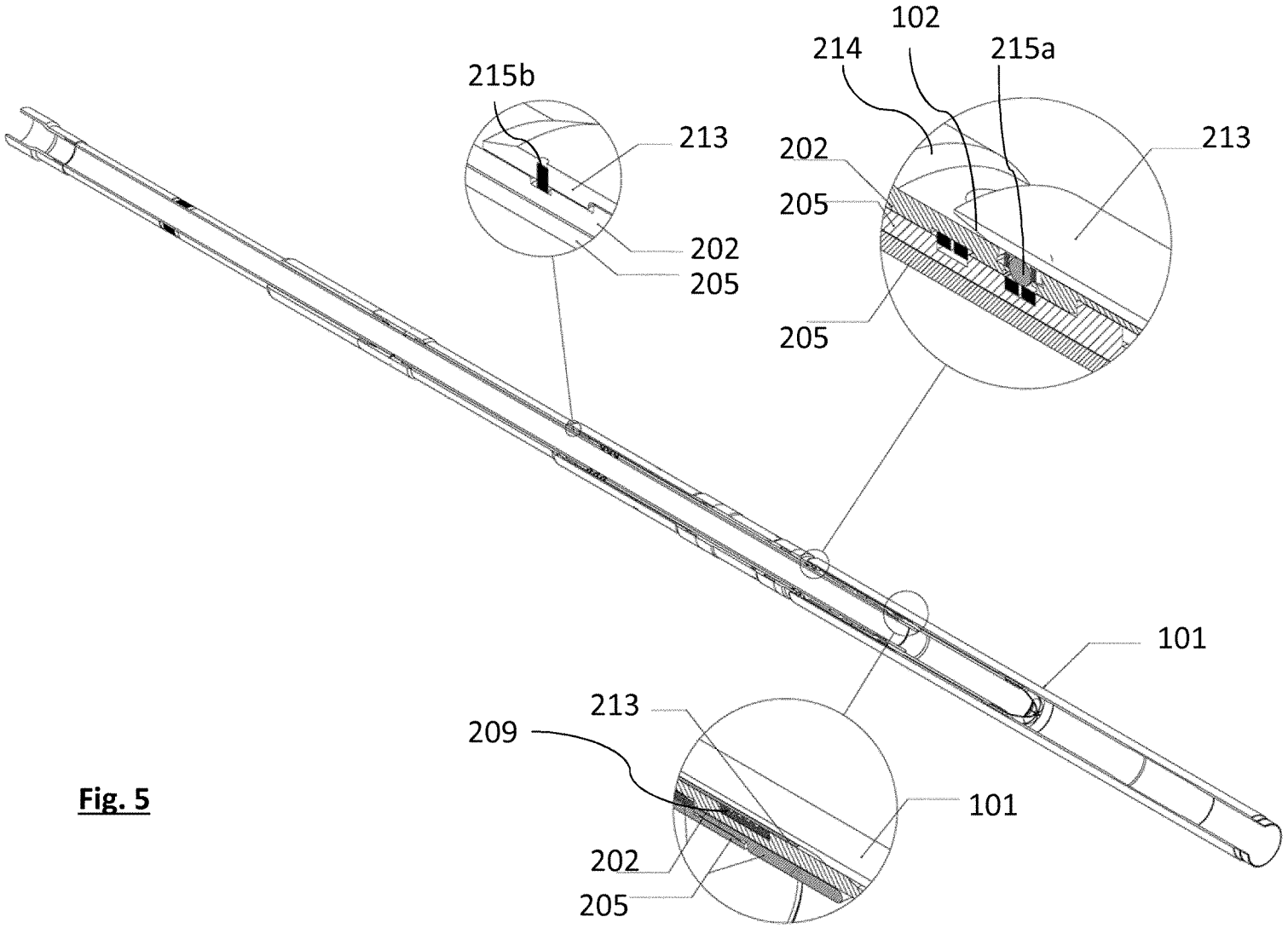
FIG. 5 shows a longitudinal cross section of a connecting assembly and of a receptacle according to an embodiment of the present invention, in a first step of connection wherein the connecting assembly enters into the receptacle.
Figure 6:
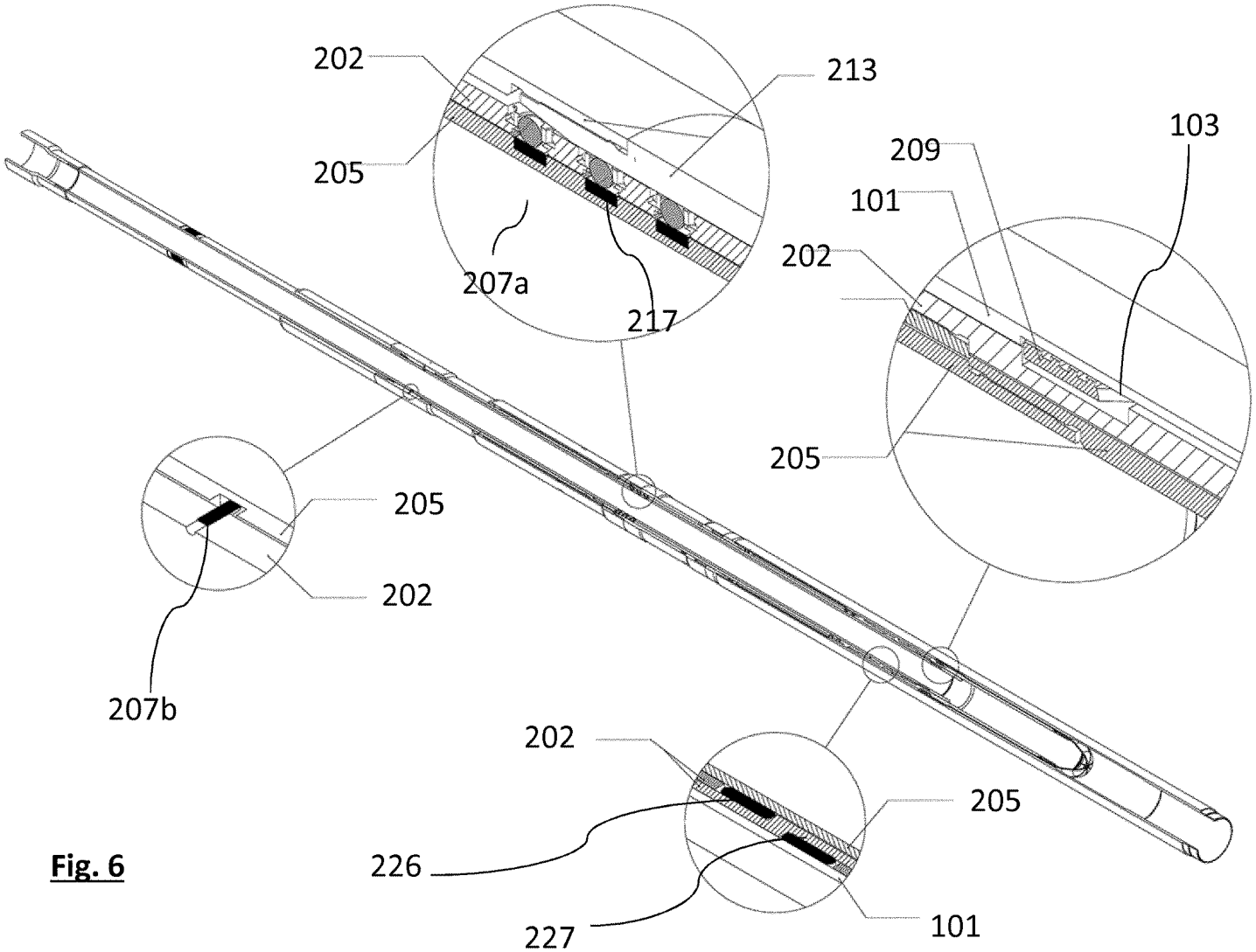
FIG. 6 shows a longitudinal cross section of a connecting assembly and of a receptacle according to an embodiment of the present invention, in a further step wherein the connecting assembly is locked to the receptacle and wherein a first locking mechanism is unlocked.
Figure 7:
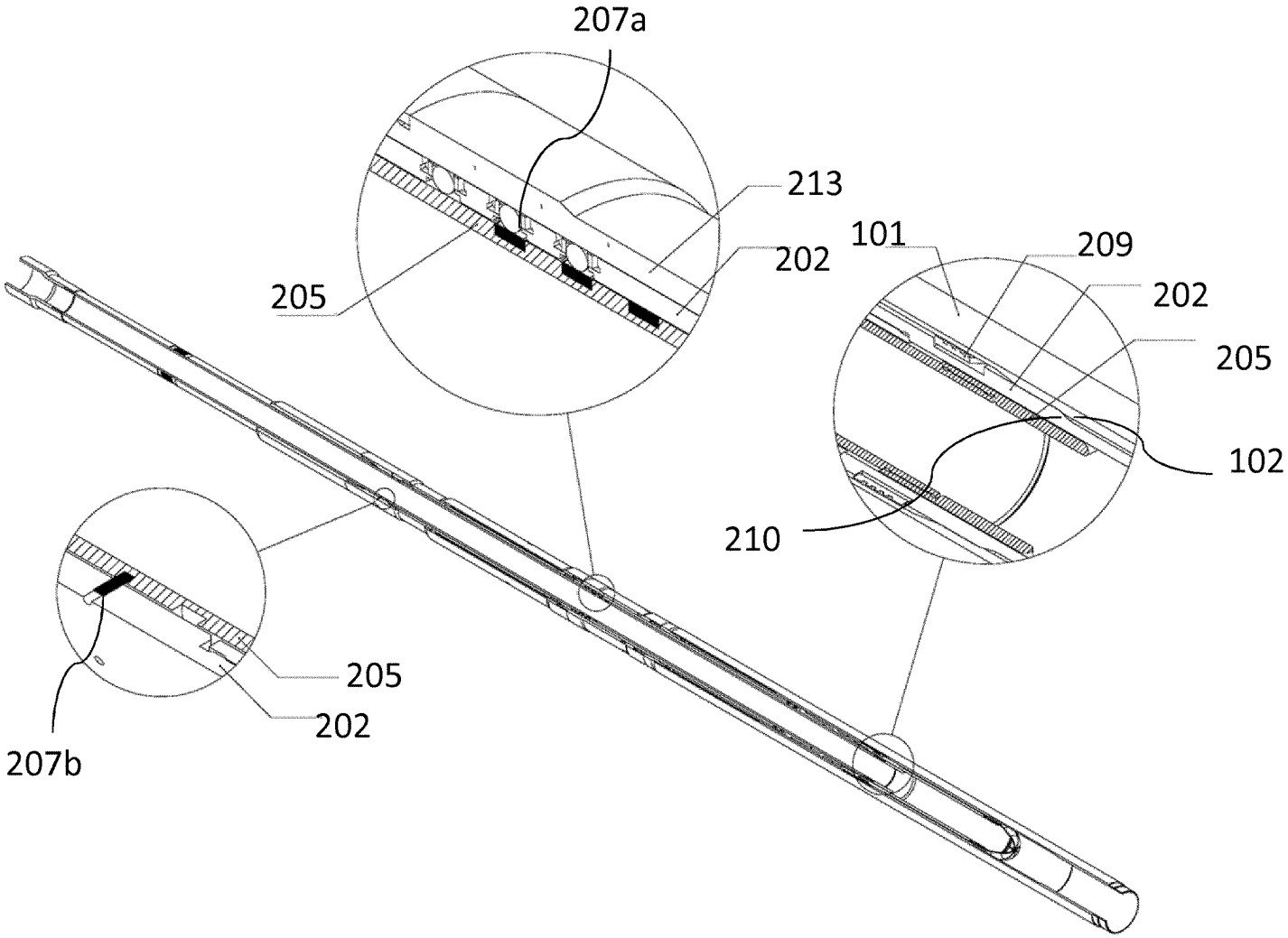
FIG. 7 shows a longitudinal cross section of a connection assembly and of a receptacle of the connection interface according to an embodiment of the present invention, in a further step wherein a second locking mechanism is unlocked.
Figure 8:
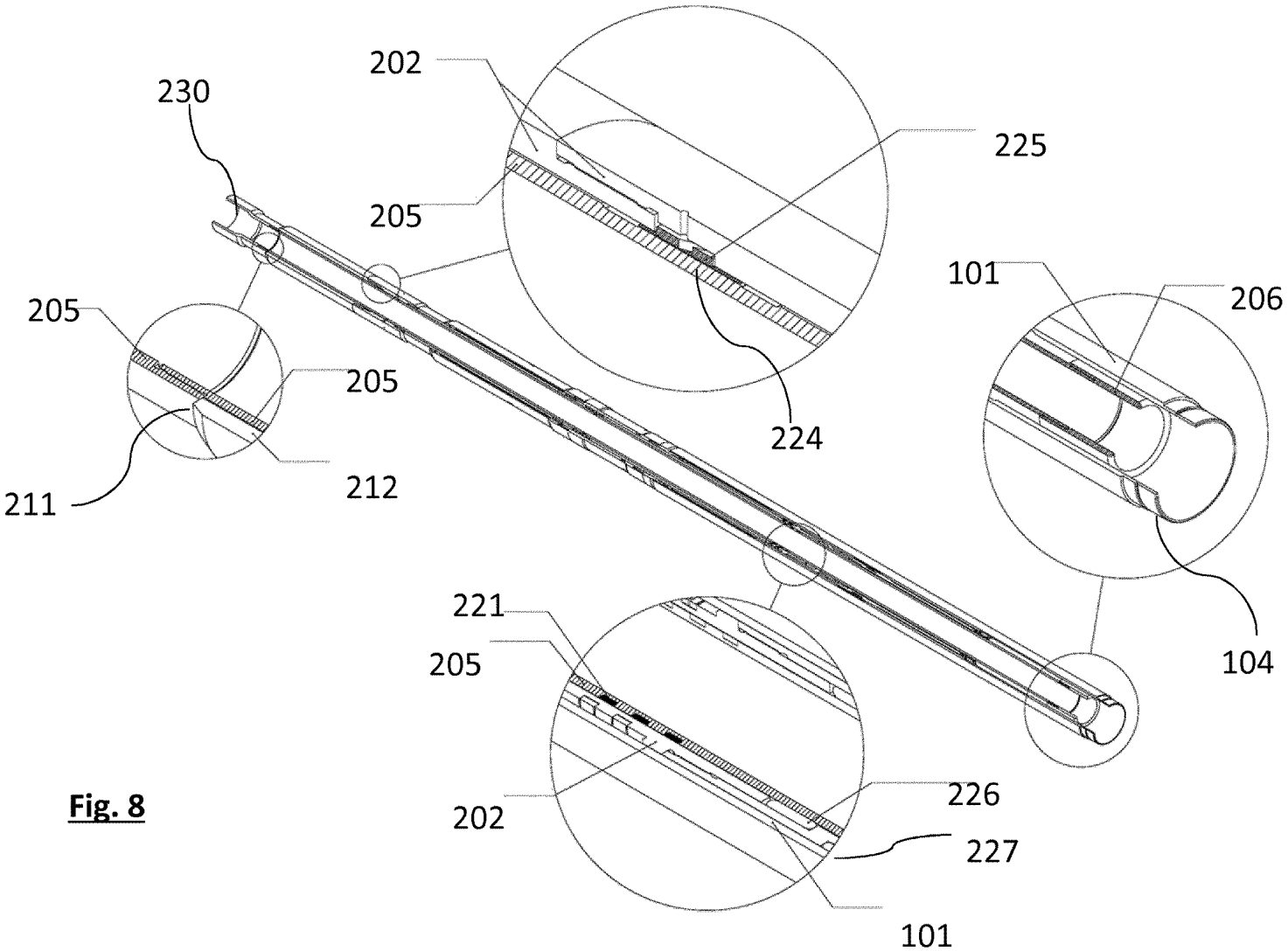
FIG. 8 shows a longitudinal cross section of a connection assembly and of a receptacle of the connection interface according to an embodiment of the present invention, in a last step wherein a fluidic connection between the receptacle and the connecting assembly is established.

In the embodiment of the connecting assembly as represented in FIG. 2, the locking mechanism 207 for locking the second sleeve 205 to the first sleeve 202 comprises a bore sensing ball bearing mechanism 207*a* comprising balls 216*a* secured into a retaining nut 216*b* provided in the walls of the first sleeve 202, the balls 216*a* being connected to a split ring 217 that is:

- in a locking position while the connecting assembly is outside of the receptacle 101, as presented in FIGS. 2, 3*a*, and 3*b*, and while entering into the receptacle as presented in FIG. 5, the locking position wherein the balls 216*a* protrudes from the external surface of the first sleeve 202 and the split ring 217 is positioned halfway between an internal groove 218 made in the first sleeve 202 and an external groove 219 made in the second sleeve 205 such that movement of the second sleeve 205 relative to the first sleeve 202 is prevented, and;
- in an unlocking position after entrance of the connecting assembly into the receptacle 101, as presented in FIGS. 6, 7 and 8, wherein the split ring 217 is entirely inside the external groove 219 of the second sleeve 205 once the balls 216*a* have been pushed against the split ring 217, such that the movement of the second sleeve 205 relative to the first sleeve 202 is allowed, and such that the bottom end 206 of second sleeve 205 can impinge and open the end cap 204 upon a pushing force applied on the second sleeve 205.

Alternatively a shear pin 207*b* is arranged between the first sleeve 202 and the second sleeve 205.

Preferably, a shear pin 207*b* is arranged between the first sleeve 202 and the second sleeve 205 in combination with the set of bore sensing ball bearings 207*a* for locking the second sleeve 205 to the first sleeve 202. The shear pin 207*b* shears upon a compression force applied on the connecting assembly against the receptacle. The shear pin cannot shear before the set of bore sensing ball bearings has not been set in its unlocked configuration. The shearing of the shear pin gives a clear load signature when the second sleeve is released from the first sleeve.

A latching mechanism 209 for locking the connecting assembly 201 to a mating receptacle 101 is also provided on the first sleeve 202. The latching mechanism 209 can be any one of the latching mechanisms as described for the first embodiment.

In the embodiment of FIG. 2, the connecting assembly 201 comprises:

- a third sleeve 213 surrounding at least a portion of the first sleeve 202, and
- a locking mechanism 215*a*, 215*b* between the third sleeve 213 and the first sleeve 202 adapted to:
  - lock the third sleeve 213 in a first position relative to the first sleeve 202 wherein the third sleeve 213 covers the latching mechanism 209 and;
  - unlock the third sleeve 213 from the first sleeve 202 to allow movement of at least the first sleeve 202 relative to the third sleeve 213 such as to uncover the latching mechanism 209 when the connection assembly 201 is plugged into the receptacle 101.

The third sleeve 213 preferably comprises an external shoulder 214 adapted to be retained by an abutment provided on the receptacle 101 when the connecting assembly enters into the receptacle to allow at least the first sleeve 202 to move relative to the third sleeve 213.

Figure 4:
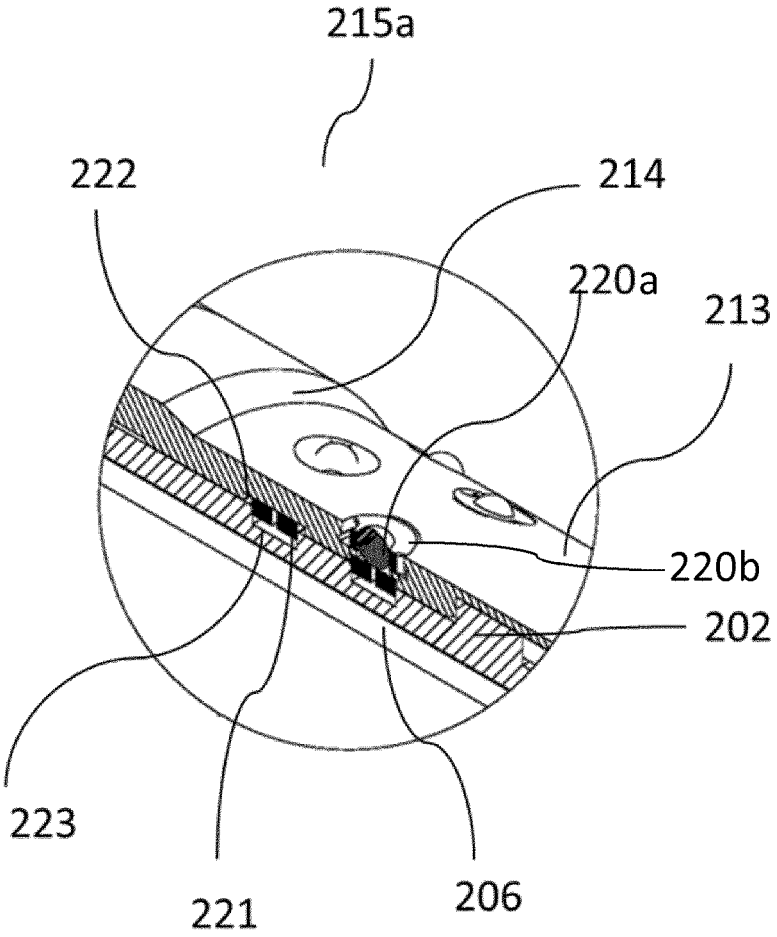
FIG. 4 shows an enlarged view of another part of the connecting assembly according to an embodiment of the present invention.

The locking mechanism 215*a* between the third sleeve 213 and first sleeve 202 preferably comprises of bore sensing ball bearing mechanism 215*a*, comprising balls 220*a* secured into a retaining nut 220*b* provided in the wall of the third sleeve 213, the balls 220*a* being connected to a split ring 221 that is:

- in a locking position while the connecting assembly is outside of the receptacle 101, as presented in FIGS. 2 and 4, the locking position wherein the balls protrudes from the external surface of the third sleeve 213 and the split ring 221 is positioned halfway between an internal groove 222 made in the third sleeve 213 and an external groove 223 made in the first sleeve 202 such that movement of the third sleeve 205 relative to the first sleeve 202 is prevented, and;
- in an unlocking position while the set of bore sensing ball bearings 215*a* is entering into the receptacle 101, as presented in FIG. 5 and while the bore sensing ball bearings are into the receptacle as presented in FIGS. 6, 7 and 8, the unlocking position wherein the split ring 221 is entirely inside the external groove 223 of the first sleeve 202 once the balls 220*a* have been pushed against the split ring 221, such that the movement of the third sleeve 213 relative to at least the first sleeve 202 is allowed.

The set of bore sensing ball bearings 215*a* of the third sleeve 213 is provided between the external shoulder 214 of the third sleeve and the bottom extremity of the third sleeve oriented towards the bottom connecting end 203 of the connecting assembly 201.

Alternatively the third sleeve comprises a shear pin 215*b* provided between the third sleeve 213 and the first 202 sleeve.

Preferably, in addition with the set of bore sensing ball bearings 215*a* of the third sleeve 213, the third sleeve comprises a shear pin 215*b* provided between the third sleeve 213 and the first 202 sleeve. The shear pin 215*b* shears upon a compression force applied on the connection assembly 201 against the receptacle 101. The shear pin 215*b* cannot shear before the set of bore sensing ball bearings has not been set in its unlocked configuration. The shearing of the shear pin 215*b* gives a clear load signature when the third sleeve has been released from the first sleeve.

Preferably, as represented in an enlarged view of FIG. 3*a*, the third sleeve 213 comprises an inner recessed section 229 that covers the set of bore sensing ball bearings 207*a* locking the second sleeve 205 to the first sleeve 202. The inner recessed section 229 of the third sleeve 213 is terminated by an abutment 228 preferably inclined for pushing the balls 216 of the first sleeve 202 against the split ring 218, thereby unlocking the first sleeve 202 from the second sleeve 205 when the first sleeve 202 is moved relative to the third sleeve 213.

Preferably, the second sleeve 205 comprises an outwardly extending buttress thread 224 and the first sleeve 202 comprises an inwardly extending ratchet ring 225 the buttress thread 224 and the ratchet ring 225 being arranged to prevent backwards movement of the second sleeve when the fluidic connection is established between the connecting assembly and the receptacle.

The invention relates to a connecting assembly to be plugged into a mating receptacle, the connecting assembly comprising a first sleeve and a second sleeve, and a ratchet; wherein the first sleeve comprises a shutter for preventing entrance of materials, wherein the second sleeve comprises the top connecting end located outside of the first sleeve and has a bottom end opposed to the top connecting end, wherein the dimensions of the first sleeve and second sleeve are adapted such that when a latching mechanism is unlocked, the second sleeve is allowed to move relative to the first sleeve to impinge upon and open the shutter wherein the ratchet is adapted to prevent movement of the second sleeve in a second direction.

According to a second aspect, the present invention is related to a receptacle 101 comprising a bore adapted to receive a connecting assembly 201 according to any one of the embodiments described herein above, the receptacle comprising a top end 105 and a bottom end 104, the bottom end 104 having a connecting means for connection to a first tubing section 100 and opposite to the top end 105.

Preferably, the receptacle comprises one or more abutments for retaining one or more sleeve of the connecting assembly.

Preferably, the receptacle comprises inner sections adapted to receive a latching mechanism for locking the connection assembly to the receptacle.

According to a third aspect, the present invention is related to a method for realization of a wellbore comprising the steps of:

(i) lowering a first tubing section 100 into a wellbore;

(ii) providing a receptacle 101 as disclosed herein above to the first tubing section;

(iii) providing a connecting assembly 201 to a second tubing section 200 and lowering the second tubing section with the connection assembly oriented towards the receptacle 101 to plug the connection assembly 201 into the receptacle 101.

Figure 9A:
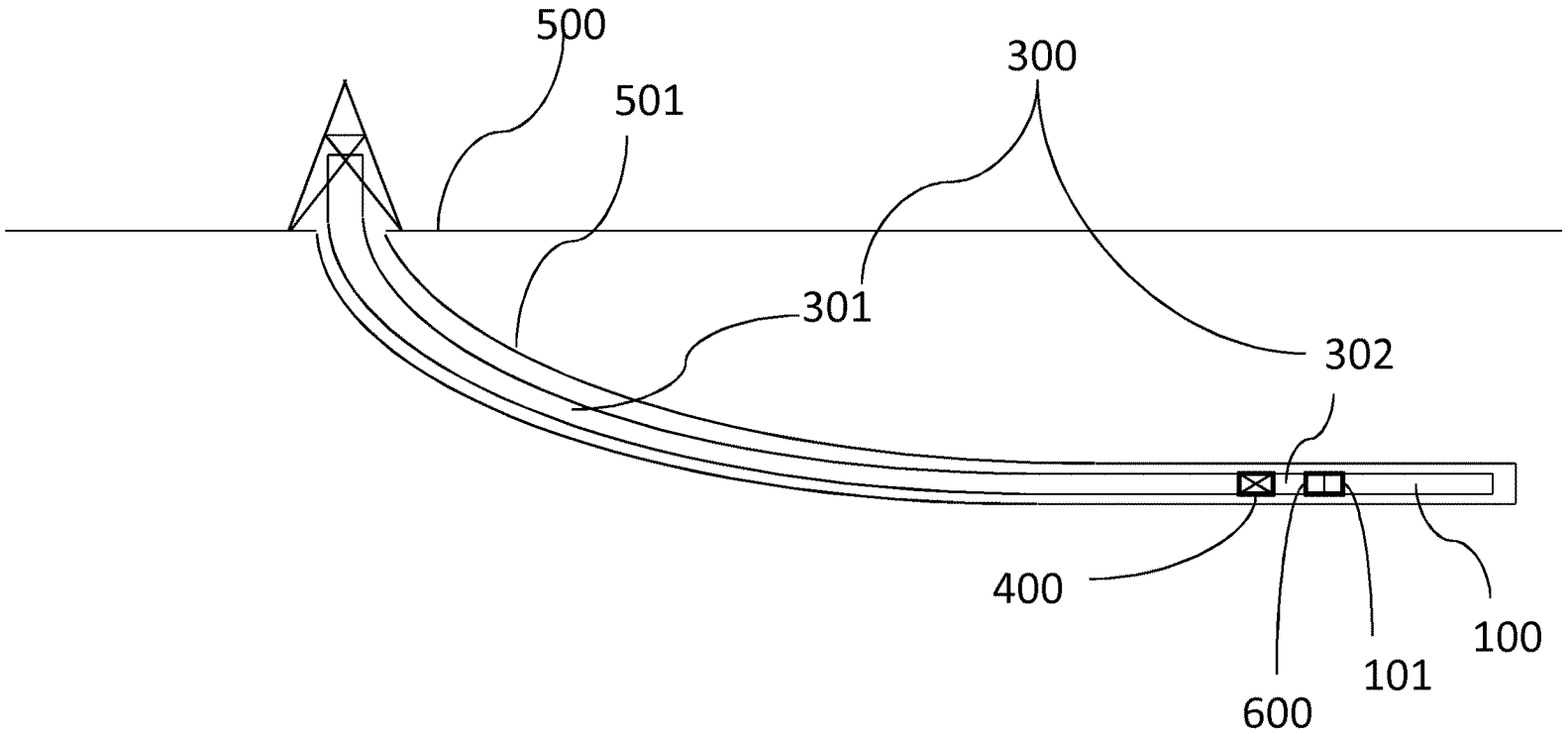
FIG. 9*a* shows a cross sectional view of a wellbore wherein a first tubing section is installed according to the method of the present invention.
Figure 9B:
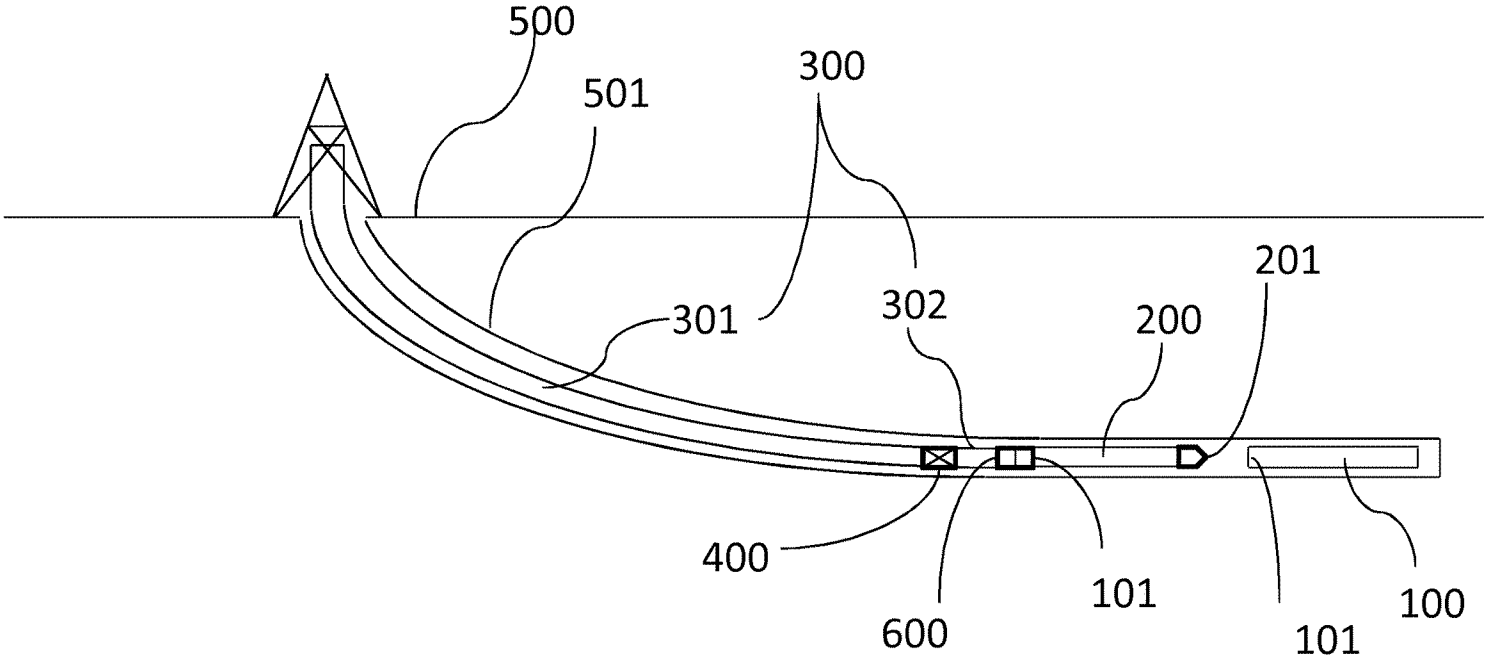
FIG. 9*b* shows a cross sectional view of a wellbore wherein a second tubing section provided with a connecting assembly is lowered down into a wellbore to be connected with the first tubing section of FIG. 9*a*, according to the method of the present invention.

Preferably, the first liner section or casing section is attached to a work string 300 comprising a lockable swivel assembly 400 as presented in FIG. 9*a*. A first work string section 301 comprised between the wellbore's surface 500 and the swivel assembly 400 is rotated relative to a second work string section 302 connected to the first tubing section 100 such as to break the friction between the first work string section 301 and the wall of the wellbore 501 and prevent damaging of the non-rotating first tubing section 100.

A top end of a first tubing section 100 is connected to the bottom end 104 of the receptacle 101 as described herein above. The tubing section 100 is connected with the receptacle 101 to a work string that comprises a disconnection means 600, for example a back off sub, adapted to selectively connect to the receptacle 101 or disconnect from the receptacle. Alternatively, the disconnection means 600 is adapted to selectively connect to another part of the first tubing section adjacent to the receptacle or to disconnect from the another part.

The lockable swivel assembly 400 is preferably provided in the work string at the vicinity of the disconnection means 600.

The first tubing section 100 is lowered down until a desired depth of a wellbore while the part of the work string upstream the swivel assembly 400 is allowed to rotate relative to the first tubing section, such that to reduce the friction between the work string and the wall of wellbore, to prevent first tubing section from damaging and to allow the first tubing section to be lowered down at extended depth of the wellbore. The lockable swivel assembly 400 is locked and then the work string 300 is disconnected from the first tubing section 100 and removed back to the surface 500 of the wellbore. Then the top end 230 of a connecting assembly 201 as disclosed herein above is attached to the bottom of a second tubing section 200, and optionally, the top end of the second tubing section 200 is further provided by a second receptacle 101 for connecting a further tubing section. The second tubing section 200 is lowered down in the wellbore until the connecting assembly 201 enters into the receptacle 101.

The connecting steps between a receptacle and the connecting assembly according to the embodiment of FIG. 2 will be described thereafter in regard with the FIGS. 2, and 5 to 8.

In FIG. 2, the connecting assembly 201 is arranged such that the second sleeve 205 is locked to the first sleeve in a position wherein the bottom end 206 of the second sleeve 205 is inside the first sleeve 202 at a distance from the end cap 204 provided at the bottom connecting end 203 of the first sleeve 202. The bore sensing ball bearing mechanism 207*a* for locking the second sleeve 205 to the first sleeve 202 is arranged such that the balls 216*a* protrudes from the external surface of the first sleeve 202 and the split ring 217 is in a locking position locking the second sleeve 205 to the first sleeve 202. A shear pin 207*b* also locks the second sleeve 205 to the first sleeve 202. The third sleeve 213 of the connecting assembly is locked in a position relative to the first sleeve wherein the latching mechanism 209 is covered by the third sleeve 213 and the inner recess 228 of the third sleeve 213 encloses the balls 216*a* protruding from the external surface of the first sleeve 202. The bore sensing ball bearing mechanism 215*a* for locking the third sleeve 213 to the first sleeve is arranged such that the balls 220*a* protrude from the external surface of the third sleeve 213 and the split ring 221 is in a locking position locking the third sleeve 213 to the first sleeve. A shear pin 215*b* also locks the third sleeve 213 to the first sleeve 202.

In FIG. 5, the connecting assembly is entering into a mating receptacle 101. The bore sensing ball bearing mechanism 215*a* is entering into the receptacle 101 and the inner wall of the receptacle 101 pushes the balls 220*a* of the bore sensing ball bearing mechanism 215*a* against the split ring 221 that moves entirely into the external groove 223 of the first sleeve 202. The shoulder 214 of the third sleeve 213 is retained against the top extremity 105 of the receptacle 101. The shear pin 215*b* still locks the third sleeve 213 to the first sleeve 202. By applying a compressive force on the connecting assembly, the shear pin 215*b* shears and the first sleeve 202 moves relative to the third sleeve 213 together with the second sleeve as presented in FIG. 6. While the first sleeve 202 is moving relative to the third sleeve 213, the balls 216*a* of the bore sensing ball bearing mechanism 207*a* that locks the first sleeve 202 to the second sleeve 205 are pushed against the split ring 217 by the inner wall of the third sleeve 213. The split ring moves entirely into the external groove 219 of the second sleeve 205. The shear pin 207*b* still locks the first sleeve 202 to the second sleeve 205. The latching mechanism 209 has been uncovered by the third sleeve 213 and is expanded into a groove 103 provided in the inner bore of the receptacle 101, thereby locking the first sleeve 202 to the receptacle.

FIG. 7, shows the external shoulder 210 of the first sleeve 202 that is retained against an inner abutment 102 of the receptacle. By further applying a compressive force on the connecting assembly against the receptacle, the shear pin 207*b* shears and unlock the second sleeve 205 from the first sleeve. As presented in FIG. 8, the second sleeve 205 slides relative to the first sleeve towards the end cap 204, and the bottom end 206 of the second sleeve 205 impinges and opens the end cap 204 provided at the bottom connecting end 203 of the connection assembly, thereby providing a fluidic and safe connection between the first tubing section 100 and the second tubing section 200. An external shoulder 211 of the second sleeve abuts against the top end 212 of the first sleeve 202, thereby stopping the movement of the second sleeve 205 relative to the first sleeve 202, and a buttress thread 224 at the external surface of the second sleeve 205 engages with a ratchet ring provided at the inner surface of the first sleeve 202, thereby preventing backwards movement of the second sleeve 205 relative to the first sleeve 202. A first sealing means 226 is arranged between the first sleeve 202 and the second sleeve 205, and a second sealing means 227 is arranged between the first sleeve 202 and the receptacle 101.

According to the present invention, a plurality of tubing sections such as liner section, casing section or screens, can be inserted and connected to each other in deep areas of a wellbore. The present invention provides safe and durable connection between the tubing sections. The shape of the bottom end of the connecting assembly prevents entrance of materials into the bore of the tubing section and the step of connection between a first tubing assembly and a second tubing assembly doesn't necessitate anymore a step of drilling a shoe.

The invention claimed is:

1. A connecting assembly to be plugged into a mating receptacle, the connecting assembly comprising:

a first sleeve, wherein the first sleeve comprises a bottom connecting end of the connecting assembly and has a first sleeve top end opposite to the bottom connecting end, the bottom connecting end being provided with a shutter for preventing entrance of materials;

a second sleeve, wherein the second sleeve comprises a top connecting end of the connecting assembly, and wherein the second sleeve axially extends beyond the first sleeve top end such that the top connecting end is not surrounded by the first sleeve, and wherein a bottom end of the second sleeve is opposed to the top connecting end;

a first latching mechanism attached to the first sleeve and the second sleeve, wherein the first latching mechanism is adapted to lock the second sleeve in a position relative to the first sleeve such that the bottom end of the second sleeve is surrounded by the first sleeve, and wherein the dimensions of the first sleeve and the second sleeve are adapted such that when the first latching mechanism is unlocked, the second sleeve is allowed to move in a first direction relative to the first sleeve to impinge upon and open the shutter;

a second latching mechanism attached to the first sleeve and adapted to lock the connecting assembly to the mating receptacle;

a third sleeve surrounding at least a portion of the first sleeve; and a third latching mechanism between the third sleeve and the first sleeve adapted to lock the third sleeve in a first position relative to the first sleeve, wherein the third sleeve covers the second latching mechanism, and wherein the third latching mechanism is adapted to unlock the third sleeve from the first sleeve to allow movement of the first sleeve relative to the third sleeve to uncover the second latching mechanism when the connecting assembly is plugged into the mating receptacle.

2. The connecting assembly according to claim 1, wherein the shutter comprises scores for facilitating the opening of the shutter.

3. The connecting assembly according to claim 1 wherein the shutter has a convex shape protruding from the bottom connecting end.

4. The connecting assembly according to claim 1 wherein the first sleeve of the connecting assembly comprises an external shoulder adapted to be retained by the mating receptacle.

5. The connecting assembly according to claim 1, wherein the second sleeve comprises an external shoulder and the first sleeve comprises an abutment adapted to retain the external shoulder of the second sleeve.

6. The connecting assembly according to claim 1, wherein the first latching mechanism comprises:

a bore sensing ball bearings mechanism comprising balls secured into retaining nuts in a wall of the first sleeve, the balls being connected to a split ring that is:

in a locking position while the connecting assembly is outside of the mating receptacle, the locking position wherein the balls protrude from an external surface of the first sleeve, and wherein the split ring is positioned halfway between an internal groove made in the first sleeve and an external groove made in the second sleeve such that movement of the second sleeve relative to the first sleeve is prevented; and in an unlocking position after entrance of the connecting assembly into the mating receptacle, the unlocking position wherein the split ring is entirely inside the external groove of the second sleeve once the balls have been pushed against the split ring, such that the movement of the second sleeve relative to the first sleeve is allowed.

7. The connecting assembly according to claim 1, wherein the third latching mechanism comprises:

a bore sensing ball bearings mechanism, comprising balls secured into retaining nuts provided in a wall of the third sleeve, and being connected to a split ring that is:

in a locking position while the connecting assembly is outside of the mating receptacle, wherein the balls protrude from an external surface of the third sleeve and wherein the split ring is positioned halfway between an internal groove made in the third sleeve and an external groove made in the first sleeve such that movement of the third sleeve relative to the first sleeve is prevented, and in an unlocking position while the bore sensing ball bearings mechanism is entering into the mating receptacle and while the bore sensing ball bearings mechanism is into the mating receptacle, the unlocking position wherein the split ring is entirely inside the external groove of the first sleeve once the balls have been pushed against the split ring, such that the movement of the third sleeve relative to the first sleeve is allowed.

8. The connecting assembly according to claim 1 wherein:

the second sleeve comprises an outwardly extending buttress thread, and the first sleeve comprises an inwardly extending ratchet ring, and wherein the inwardly extending ratchet ring is arranged to prevent backwards movement of the second sleeve by engaging with the buttress thread.

9. The connecting assembly according to claim 1, wherein a first seal is arranged between the first sleeve and the second sleeve, and a second seal is arranged around the first sleeve.

10. The connecting assembly of claim 1, wherein:

the first latching mechanism comprises a set of ball bearings, wherein the set of ball bearings are in contact with the first sleeve to the second sleeve, and wherein a set of balls of the set of ball bearings are in contact with the first sleeve, and wherein a set of split rings of the set of ball bearings lock the second sleeve to the first sleeve;

the third sleeve comprises an inner wall element to push the set of balls into the set of split rings, wherein the inner wall element is movable to push the set of balls after the third latching mechanism is unlocked; and the second sleeve comprises an external groove to receive the set of split rings.

11. The connecting assembly of claim 1, wherein the first latching mechanism comprises a radio frequency identification device (RFID) reader, and wherein an interaction with an RFID tag unlocks the first latching mechanism.

12. The connecting assembly of claim 1, wherein the first latching mechanism comprises a radio frequency identification device (RFID) reader, and wherein an interaction with an RFID tag unlocks the second latching mechanism.

13. The connecting assembly of claim 1, wherein the first latching mechanism comprises a shear pin attached to the first sleeve.

14. A system comprising:

a tubing section;

a mating receptacle, wherein the mating receptacle is attached to the tubing section; and a connecting assembly that is attached to an abutment of the mating receptacle, wherein the abutment is adapted to receive the connecting assembly, and wherein the connecting assembly comprises:

a first sleeve, wherein the first sleeve comprises a bottom connecting end of the connecting assembly and has a first sleeve top end opposite to the bottom connecting end, the bottom connecting end being provided with a shutter for preventing entrance of materials;

a second sleeve, wherein the second sleeve comprises a top connecting end of the connecting assembly, and wherein the second sleeve axially extends beyond the first sleeve top end such that the top connecting end is not surrounded by the first sleeve, and wherein a bottom end of the second sleeve is opposed to the top connecting end;

a first latching mechanism attached to the first sleeve and the second sleeve, wherein the first latching mechanism is adapted to lock the second sleeve in a position relative to the first sleeve such that the bottom end of the second sleeve is surrounded by the first sleeve, and wherein the dimensions of the first sleeve and the second sleeve are adapted such that when the first latching mechanism is unlocked, the second sleeve is allowed to move in a first direction relative to the first sleeve to impinge upon and open the shutter;

a second latching mechanism attached to the first sleeve and adapted to lock the connecting assembly to the mating receptacle;

a third sleeve surrounding at least a portion of the first sleeve; and a third latching mechanism between the third sleeve and the first sleeve adapted to lock the third sleeve in a first position relative to the first sleeve, wherein the third sleeve covers the second latching mechanism, and wherein the third latching mechanism is adapted to unlock the third sleeve from the first sleeve to allow movement of the first sleeve relative to the third sleeve to uncover the second latching mechanism when the connecting assembly is plugged into the mating receptacle.

15. A method comprising:

lowering a mating receptacle into a wellbore, wherein the mating receptacle is attached to a tubing section;

lowering a connecting assembly into the wellbore after the mating receptacle is lowered, wherein the connecting assembly comprises:

a first sleeve, wherein the first sleeve comprises a bottom connecting end of the connecting assembly and has a first sleeve top end opposite to the bottom connecting end, the bottom connecting end being provided with a shutter for preventing entrance of materials;

a second sleeve, wherein the second sleeve comprises a top connecting end of the connecting assembly, and wherein the second sleeve axially extends beyond the first sleeve top end such that the top connecting end is not surrounded by the first sleeve, and wherein a bottom end of the second sleeve is opposed to the top connecting end;

a first latching mechanism attached to the first sleeve and the second sleeve, wherein the first latching mechanism is adapted to lock the second sleeve in a position relative to the first sleeve such that the bottom end of the second sleeve is surrounded by the first sleeve, and wherein the dimensions of the first sleeve and the second sleeve are adapted such that when the first latching mechanism is unlocked, the second sleeve is allowed to move in a first direction relative to the first sleeve to impinge upon and open the shutter;

a second latching mechanism attached to the first sleeve and adapted to lock the connecting assembly to the mating receptacle;

a third sleeve surrounding at least a portion of the first sleeve; and a third latching mechanism between the third sleeve and the first sleeve adapted to lock the third sleeve in a first position relative to the first sleeve, wherein the third sleeve covers the second latching mechanism, and wherein the third latching mechanism is adapted to unlock the third sleeve from the first sleeve to allow movement of the first sleeve relative to the third sleeve to uncover the second latching mechanism when the connecting assembly is plugged into the mating receptacle.

16. The method of claim 15, wherein the first latching mechanism comprises an electronically actuated locking device, and wherein the method further comprises sending an electronic message to the first latching mechanism to unlock the first latching mechanism via the electronically actuated locking device.

17. The method of claim 15, wherein the tubing section is attached to a workstring comprising a swivel assembly and wherein a first workstring section positioned between a wellbore surface and the swivel assembly is rotated relative to a second workstring section including the tubing section.

18. The method of claim 15, wherein the third latching mechanism comprises a set of bore sensing ball bearings and a shear pin, and wherein the method further comprises:

setting the set of bore sensing ball bearings in an unlocked configuration; and applying a compressive force on the connecting assembly against the mating receptacle to cause the shear pin to shear, wherein the compressive force is applied after the set of bore sensing ball bearings is set in the unlocked configuration.

19. The method of claim 15, wherein the third sleeve comprises an inner recessed section that covers the first latching mechanism, and wherein the first latching mechanism comprises a set of balls and a split ring, and wherein the method further comprises moving the third sleeve relative to the first sleeve to push the set of balls against the split ring, wherein pushing the set of balls unlocks the first sleeve from the second sleeve by unlocking the first latching mechanism.

20. The method of claim 15, wherein the first latching mechanism comprises an electronically actuated locking device, and wherein the method further comprises sending an electronic message to the first latching mechanism to unlock the first latching mechanism via the electronically actuated locking device.

* * * * *